US005844369A

United States Patent [19]

Yoshizako et al.

[11] Patent Number: 5,844,369

[45] Date of Patent: Dec. 1, 1998

[54] AUTOMATIC PHASE ADJUSTING CIRCUIT FOR A PLASMA PROCESSING APPARATUS

[75] Inventors: Yuji Yoshizako, Osaka; Tsuneo Ito, Hyogo; Akie Nakamoto, Osaka, all of Japan

[73] Assignee: Daihen Corporation, Osaka, Japan

[21] Appl. No.: 855,916

[22] Filed: May 14, 1997

[30] Foreign Application Priority Data

May 15, 1996 [JP] Japan ..... 8-146591

[51] Int. Cl.[6] ..... H05H 1/24

[52] U.S. Cl. ..... 315/111.21; 315/111.31; 333/17.1

[58] Field of Search ..... 315/111.21, 111.31; 333/17.1

[56] References Cited

U.S. PATENT DOCUMENTS 4,871,421 10/1989 Ogle et al. ..... 156/643
5,228,939 7/1993 Chu ..... 156/345
5,576,629 11/1996 Turner et al. ..... 315/111.21 X

FOREIGN PATENT DOCUMENTS 2663806 12/1991 France ..... 315/111.31

*Primary Examiner*—Steven Mottola
*Assistant Examiner*—Justin P. Bettendorf
*Attorney, Agent, or Firm*—Scully, Scott Murphy and Presser

[57] ABSTRACT

A phase adjusting circuit for adjusting phases of output powers from two high frequency power generators in a plasma processing apparatus comprises first and second synthesizing circuits for generating first and second high frequency signals of a predetermined waveform with frequencies of f0 and f0±Δf (Δf<<f0), a phase difference detection circuit for detecting a phase difference between detection signals of plate electrodes, a third waveform synthesizing circuit for generating a high frequency signal with frequency and waveform same as the first frequency signal which has a phase determined from a phase error between a set phase difference and an output from the phase difference detection circuit and a phase adjusting circuit which determines output powers of the two high frequency power generators base on outputs of the first and third waveform synthesizing circuits.

8 Claims, 5 Drawing Sheets

AUTOMATIC PHASE ADJUSTING CIRCUIT FOR A PLASMA PROCESSING APPARATUS

BACKGROUND OF THE INVENTION

1. Field of the Invention

The present invention relates to a plasma processing apparatus and more particularly, to a phase adjustment circuit in a plasma processing apparatus for adjusting the phases of the electrical outputs of two high frequency power generators in plasma processing.

2. Description of the Prior Art

In a plasma processing apparatus utilizing high frequency power as an excitation source to process semiconductor wafers or the like, two or more excitation high frequency power sources are used in some cases in order to control the electron temperature, density, potential, etc. of plasma. In one arrangement for this purpose, for example, the phase of a high frequency voltage to be applied to a parallel plate electrode and generally used to generate plasma is optionally adjusted.

FIG. 5 is a block diagram of the plasma processing apparatus using a phase adjustment circuit referred to above. In FIG. 5, reference numerals represent respectively: 1 a phase adjustment circuit; 2 and 3 high frequency power generators; 4 and 5 automatic matching devices; 6 and 7 processing voltage detection circuits; 8 a plate electrode; 9 an object to be processed; and 10 a plasma generation chamber.

The phase adjustment circuit 1 has an input of two high frequency voltages detected by the processing voltage detection circuits 6, 7, and measures a phase difference of the two voltages, outputting two high frequency signals of the same frequency and different phases so that the adjusted phase difference becomes a preset phase difference. The two high frequency signals output from the phase adjustment circuit 1 are input to the high frequency power generators 2, 3 which in turn output high frequency powers of a frequency and a phase corresponding to those of the input signals. The automatic matching devices 4, 5 are employed to efficiently feed the powers generated at the high frequency power generators 2, 3 to the plasma generation chamber 10. The processing voltage detection circuits 6, 7 convert the high frequency voltages applied to the two plate electrodes 8 to a level which is easy to handle. The plate electrodes 8 are parallel to each other in the plasma generation chamber 10. The object 9 to be processed is loaded on the lower of the electrodes.

For generating plasma, conditions such as the type of gas pressure, etc. supplied to the plasma generation chamber 10 are required to be properly adjusted. The phases of the two high frequency voltages change when passing through the automatic matching devices 4, 5, and are influenced by a state of the plasma and therefore not constant.

The phase adjustment circuit 1 measures the two high frequency voltages input thereto and adjusts the phase difference to the preset value to make the phases coincide with each other.

FIG. 6 shows in detail a conventional phase adjustment circuit 1 used in the plasma processing apparatus of FIG. 5. In FIG. 6, reference numerals 21–30 respectively indicate: 21 a sine wave signal source; 22 a distributer; 23 and 24 amplifiers; 25 a variable delay circuit; 26 and 27 comparators; 28 a phase difference detector; 29 a phase difference setting device; and 30 an error amplifier. The phase adjustment circuit 1 also has input terminals a, b and output terminals c, d.

An input signal to each input terminal a, b of the phase adjustment circuit 1 is the voltage detected at each processing voltage detection circuit 6, 7 shown in FIG. 5. The input signal is converted to a rectangular wave signal at the comparator 26, 27 and is input to a phase difference detector 28 generally used in a phase-locked loop (PLL) circuit or the like.

The phase difference detector 28 regards as a phase difference a length of time while both of the input rectangular wave signals are at the same high level, and outputs a voltage proportional to the phase difference. The amplifier 30 amplifies an error between a set voltage preliminarily set by the phase difference setting device 29 corresponding to the preset phase difference and the output voltage from the phase difference detector 28, and outputs the error as a control voltage to the variable delay circuit 25 to be described later. The phase difference is thus controlled at the set value.

The sine wave signal source 21 generates a reference high frequency signal of a sine wave which is divided to two signals at the distributer 22. One of the divided signals is adjusted at the amplifier 23 to a level suitable to drive the high frequency power generator, 2 and is then output to the output terminal c of the phase adjustment circuit 1. The other output signal of the distributer 22 is, before output to the output terminal d of the phase adjustment circuit 1, adjusted by the amplifier 24 via the variable delay circuit 25 which changes the transmission delay time in accordance with a value of the control voltage signal to a level suitable to drive the high frequency power generator 3. If the range over which the variable delay circuit 25 can vary the transmission delay time is set to be larger than a period of the signal to be output, the phase difference of two high frequency signals output to the output terminals c, d can be optionally set.

FIG. 7 is a graph showing a relation of the phase difference and the voltage in the conventional phase adjustment circuit 1 of FIG. 6. Referring to FIG. 7, the x axis of abscissa indicates the control voltage of the variable delay circuit 25 which adjusts the phase in the phase adjustment circuit 1, while the y axis of ordinate is the phase difference controlled at the variable delay circuit 25. Supposing that the voltage to be adjusted in phase varies from vo1[V] to vo2[V] and the corresponding phase difference varies from 0 [rad] to 3 π[rad] in FIG. 7. If the phase changes exceed a control range as indicated by P1 when adjusted in the phase adjustment circuit 1 following the change of plasma and the associated operation of the matching devices, then the phase should be controlled to be returned to the controllable range. That is, the phase should be returned within one cycle in a direction opposite to a natural changing direction, i.e., to P2. A transient phase change as above hinders the plasma from being maintained stably in a stable condition.

FIG. 8 is a graph of the relation between the voltage and the phase difference detected by the conventional phase difference detector 28. In FIG. 8, the x axis of abscissa is the phase difference of two signals input to the phase difference detector 28 and the y axis of ordinate represents the output voltage of the phase difference detector 28 corresponding to the phase difference. The output voltage is different, vi1[V] and vi2[V], with the different phase differences of 0 [rad] and 2 π[rad] as is clear from this graph. More specifically, the output voltage changes discontinuously from the maximum vi2[V] to the minimum vi1[V] every 2 π[rad] phase difference, thereby impeding the stable maintenance of plasma by controlling of the phase.

SUMMARY OF THE INVENTION

An essential object of the present invention is therefore to provide a phase adjustment circuit in a plasma processing apparatus which eliminates a discontinuity in the phase difference generated in the case of analog control, and which improves the detection accuracy of the phase difference to cope with a wide range of frequencies.

In order to accomplish the above-described object, a plasma processing apparatus is provided, wherein outputs of two high frequency power generators for processing of semiconductor wafers or the like are respectively supplied to two plate electrodes in a plasma generation chamber thereby to generate plasma, wherein the outputs of the two high frequency power generators are shifted a predetermined value in phase by a phase adjustment circuit. The plasma processing apparatus comprises a frequency setting circuit for outputting pulse signals every predetermined interval, a phase difference setting circuit, first and second processing voltage detection circuits for detecting respectively terminal voltages at the plate electrodes in the plasma generation chamber, a first waveform synthesizing circuit having an input from the frequency setting circuit, thereby synthesizing/forming a high frequency signal of a predetermined waveform with a frequency f0 corresponding to the input, a second waveform synthesizing circuit, having an input from the frequency setting circuit thereby synthesizing/forming a high frequency signal of the same waveform as that generated in the first waveform synthesizing circuit, with a frequency different by $\Delta f$ ($\Delta f \ll f0$) from the frequency of the first waveform synthesizing circuit. A phase difference detection circuit has inputs of the output from the second waveform synthesizing circuit and detection signals from the first and second processing voltage detection circuits which outputs a voltage of the frequency $\Delta f$ and corresponding to a phase difference of the detection signals of the processing voltage detection circuits. A third waveform synthesizing circuit outputs a high frequency signal with a phase determined by a difference signal between a set value of the phase difference setting circuit and an output of the phase difference detection circuit, with the same frequency and the same waveform as those of the first waveform synthesizing circuit, and a central processing unit (CPU) for supervising the frequency setting circuit, phase difference setting circuit, first and second processing voltage detection circuits, first through third waveform synthesizing circuits and phase difference detection circuit, whereby the phase adjustment circuit controls one output power of the two high frequency power generators in accordance with the output of the first waveform synthesizing circuit, and controls the other output power in accordance with the output of the third waveform synthesizing circuit.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF PREFERRED EMBODIMENT

A preferred embodiment of the present invention will be described with reference to the drawings.

Figure 1:
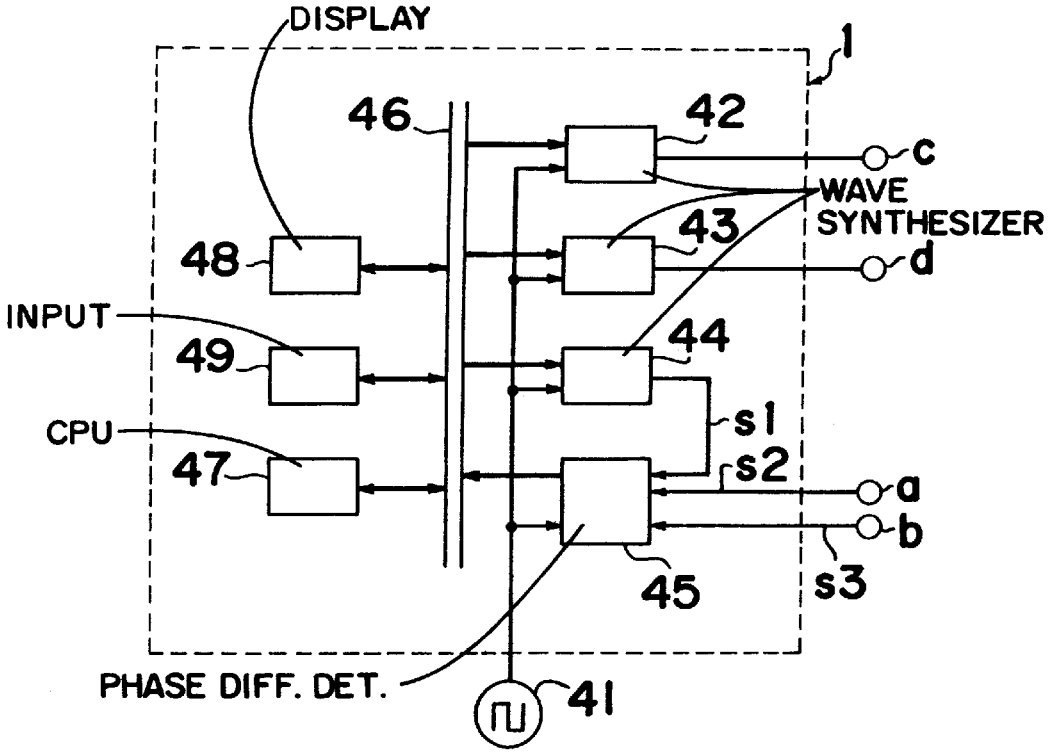
FIG. 1 is a block diagram of a phase adjustment circuit according to the present invention.

FIG. 1 is a block diagram of a phase adjustment circuit according to the present invention, wherein 41 is a clock pulse oscillation circuit, 42 a first waveform synthesizing circuit, 43 a third waveform synthesizing circuit, 44 a second waveform synthesizing circuit, 45 a phase difference detection circuit, 46 a data bus, 47 a central processing unit (CPU), 48 a display means for displaying a phase difference output from the phase difference detection circuit 45, 49 an input means for inputting an output frequency and a target phase difference therethrough, a and b input terminals of the phase difference detection circuit 45 and, c and d are output terminals of the waveform synthesizing circuits 42, 43.

In FIG. 1, a reference clock generated at the oscillation circuit 41 is fed to the waveform synthesizing circuits 42–44 and phase difference detection circuit 45. The waveform synthesizing circuits 42–44 generate and output sine wave signals based on a pulse waveform of the reference clock input thereto. The first, third waveform synthesizing circuits 42, 43 output sine wave signals as an output signal of the phase adjustment circuit 1 through the output terminals c, d. On the other hand, the second waveform synthesizing circuit 44 outputs a sine wave signal at a frequency different by $\Delta f$ from a frequency of the output signal of the first or third waveform synthesizing circuit 42, 43, to the phase difference detection circuit 45 as a reference signal.

The phase difference detection circuit 45, having inputs of detection signals of terminal voltages of the plate electrodes input through the input terminals a and b and the sine wave signal output from the second waveform synthesizing circuit 44, converts the inputs thereby to obtain a low frequency signal of a frequency, which is a difference $\Delta f$ of frequencies of the two signals, and thereafter obtains a phase difference detection signal by counting a time difference resulting from the phase difference with a period of the reference clock. The CPU 47 obtains a phase error signal from the phase difference detection signal of the frequency $\Delta f$ and a phase difference setting signal, and determines a phase to be set in the first and third waveform synthesizing circuits 42, 43.

Figure 2:
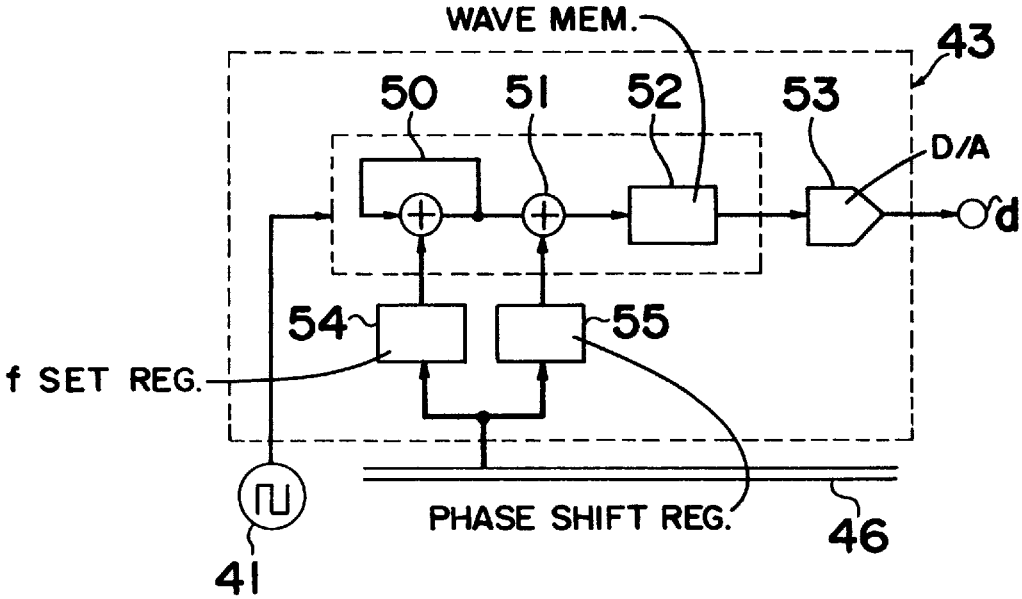
FIG. 2 is a block diagram indicating the constitution of a wave synthesizing circuit of the present invention.

FIG. 2 indicates the constitution of the third waveform synthesizing circuit 43 in a plasma processing apparatus of the present invention, as shown in FIG. 1. The circuit is a type generally called direct digital synthesis. In FIG. 2, 41 is a clock pulse oscillation circuit, 50 and 51 are adders, 52 a waveform memory circuit, 53 a D/A converter, 54 a frequency setting register for setting a value corresponding to a frequency f0 input by the input means 49, and 55 a phase shift setting register for setting a value corresponding to a phase error which is a difference of phase differences input by the input means 49 and detected at the phase difference detection circuit 45.

The first adder 50, to which an output result of the first adder 50 and the value set in the frequency setting register 54 are input outputs a value added every cycle of the reference clock, synchronously with the reference clock generated from the oscillation circuit 41. A count of bits of the adders 50, 51 is determined while an accuracy required in setting of the frequency in actual use is taken into consideration.

The output value of the first adder 50 and the set value set in the phase shift setting register 55 are input and added at the second adder 51, the result of which is an address used when a peak value preliminarily stored in the waveform memory circuit 52 is read out and output to the D/A converter 53. An output of the D/A converter 53 is adjusted to a suitable level with the reference clock and higher harmonics removed therefrom via a low pass filter and an amplifier (not shown) and then output to the output terminal d.

The first, second waveform synthesizing circuits 42, 44 are in the same constitution as the third waveform synthesizing circuit 43 shown in FIG. 2 except that the phase shift setting register 55 and the second adder 51 are not included. A frequency f0+Δf or f0−Δf which is different by Δf (Δf<<f0) from the frequency f0 of the first, third waveform synthesizing circuit 42, 43 is set in a frequency setting register of the second waveform synthesizing circuit 44.

The operation of the third waveform synthesizing circuit 43 will now be described.

If, for example, the first and second adders 50, 51 are 8-bit adders and the waveform memory circuit 52 stores peak values corresponding to phase values as tabulated in Table 1, specifically, 12-bit peak values in total including a one-bit sign code, and when the clock pulse generated by the oscillation circuit 41 has a frequency f1=80 [MHz], a waveform of 8 bits (=256) is formed in one cycle. In order to control the first waveform synthesizing circuit 42 at a frequency f2=10 [MHz], FR=(f2/f1)×$2^8$=(10/80)×256=32 should be input to the frequency setting register 54 by the input means 49 wherein FR is a ratio of f1=80 [MHz] to f2=10 [MHz] in the 8-bit (=256) cycle. Meanwhile, in order to set a phase difference Δθ to 90°, FH=(Δθ/θ)×$2^8$=(90°/360°)×256=64 as a ratio of the phase difference Δθ=90° to a phase θ=360° for 8 bits (=256) should be set in the phase shift setting register 55 by the input means 49.

TABLE 1

| Phase values | Peak values |
|---|---|
| 0 | 0 |
| 1 | 10 |
| 2 | 50 |
| . | . |
| . | . |
| . | . |
| 32 | 1300 |
| . | . |
| . | . |
| . | . |
| 64 | 1800 |
| . | . |
| . | . |
| . | . |
| 96 | 1300 |
| . | . |
| . | . |
| . | . |
| 128 | 0 |
| . | . |
| . | . |

TABLE 1-continued

| Phase values | Peak values |
|---|---|
| . | . |
| 160 | −1300 |
| . | . |
| . | . |
| . | . |
| 192 | −1800 |
| . | . |
| . | . |
| . | . |
| 224 | −1300 |
| . | . |
| . | . |
| . | . |
| 256 | 0 |

Given that output values of the first adder 50, second adder 51, frequency setting register 54, phase shift setting register 55 and waveform memory circuit 52 for every i-th clock pulse of the oscillation circuit 41 are denoted by AD1(i), AD2(i), FR, FH, MC(i) respectively, an output value AD1(m), AD2(m) of the first, second adder 50, 51 is expressed as follows when the clock pulse of the oscillation circuit 41 is i=m;

$$AD1(m)=AD1(m-1)+FR \quad (1)$$

$$AD2(m)=AD1(m-1)+FH \quad (2)$$

With FR=32 and FH=64, if the output values AD1(i) and AD2(i) of the first adder 50 and second adder 51 and MC(i) of the waveform memory circuit 52 for every clock pulse are operated according to the above expressions (1) and (2) until the clock pulse becomes i=10, this results in Table 2. Since each adder is of 8 bits, 256=0 is held when the first, second adder 50, 51 outputs AD1(8), AD2(7).

TABLE 2

| Clock | AD1 (i) | AD2 (i) | MC (i) |
|---|---|---|---|
| 0 | 0 | — | — |
| 1 | 32 | 64 | 1800 |
| 2 | 64 | 96 | 1300 |
| 3 | 96 | 128 | 0 |
| 4 | 128 | 160 | −1300 |
| 5 | 160 | 192 | −1800 |
| 6 | 192 | 224 | −1300 |
| 7 | 224 | 256 (=0) | 0 |
| 8 | 256 (=0) | 228 (=32) | 1300 |
| 9 | 32 | 64 | 1800 |
| 10 | 64 | 96 | 1300 |

Figure 7:
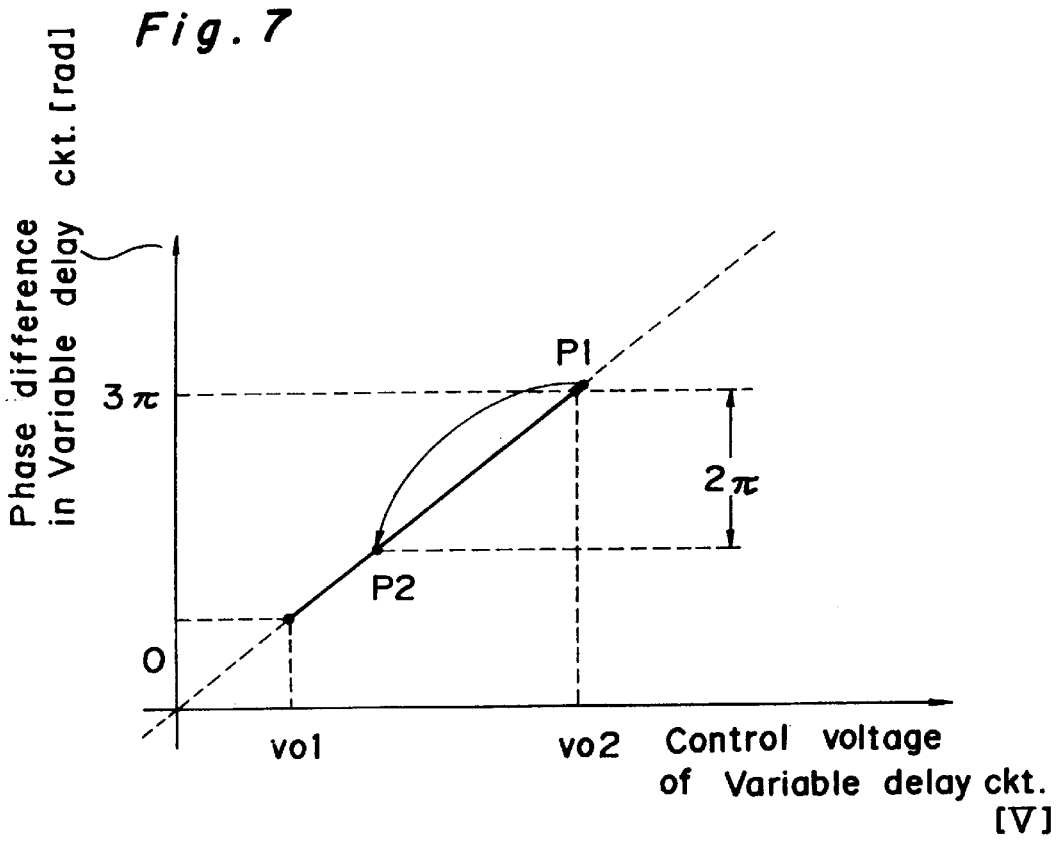
FIG. 7 is a graph showing a relation of a phase difference and a voltage in the conventional phase adjustment circuit.

The waveform memory circuit 52 outputs the peak value MC(i) corresponding to the output value, that is, the phase value as indicated in Table 2. Peak values corresponding to output values AD2(1), AD2(2), . . . , AD2(8) of the second adder 51 are MC(1)=1800, MC(2)=1300, MC(3)=0, MC(4)=−1300, MC(5)=−1800, MC(6)=−1300, MC(7)=0, MC(8)=1300 respectively. The D/A converter 53, when receiving the peak value as an input, executes D/A conversion thereby to output a waveform indicated by a solid line in FIG. 7. The reference clock and higher harmonics are removed from the output of the D/A converter 53 by the low pass filter and amplifier (not shown). After being adjusted to a suitable level, the output of the D/A converter 53 is sent out to the output terminal d.

Figure 3:
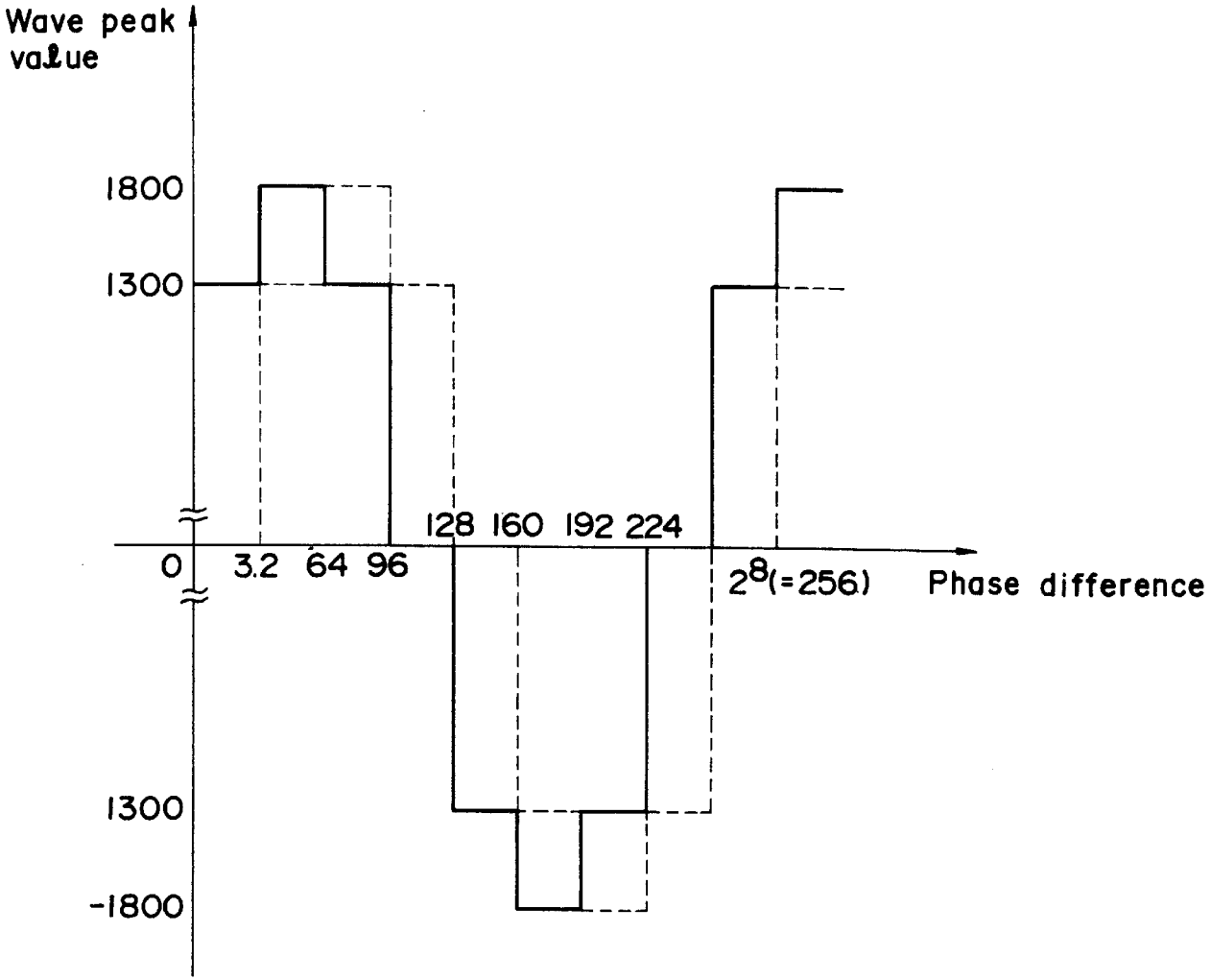
FIG. 3 shows output waveforms of the wave synthesizing circuit of FIG. 1 wherein a broken line indicates the output of the first and second waveform synthesizing circuits and a solid line indicates the output of the third waveform synthesizing circuit.

Since the first, second waveform synthesizing circuit 42, 44 correspond to the third waveform synthesizing circuit 43 excluding the second adder 51 and phase shift setting register 55 as mentioned earlier, the output of the first or second synthesizing circuit is in a waveform stored in the waveform memory circuit 52 and read out in accordance with the output AD(i) of Table 2 and therefore changes as indicated by a broken line in FIG. 3. In other words, the output of the first waveform synthesizing circuit 42 assumes the waveform shifted 90° in phase to the output of the third waveform synthesizing circuit 43 in conformity with the set value in the phase shift setting register 55.

While the frequency f1 of the clock pulse of the oscillator 41 and the set frequency f2 of the frequency setting register 54 hold a relation f1/f2=⅛ in the foregoing description, more smooth output waveforms are obtained if the ratio is increased.

Figure 4:
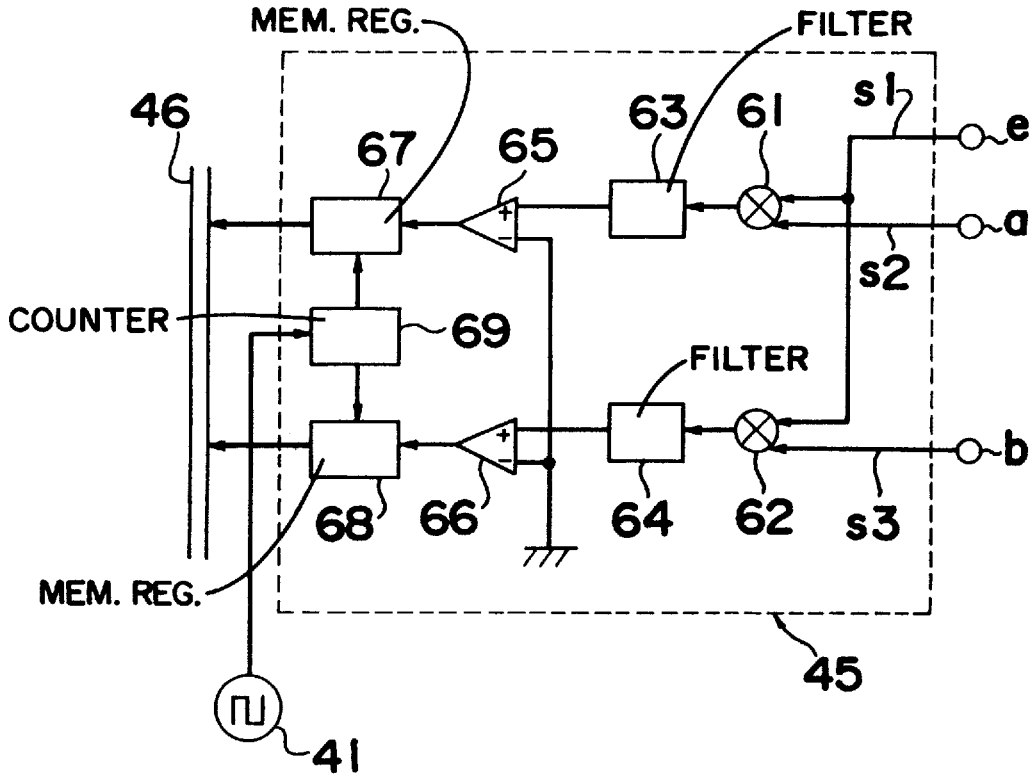
FIG. 4 is a block diagram of a phase difference detection circuit of the present invention.

FIG. 4 is a block diagram of the constitution of the phase error detection circuit 45 of the present invention. In the drawing, 61, 62 are analog multipliers, 63, 64 are low pass filters, 65, 66 are waveform shaping circuits, 67, 68 are memory registers, 69 a counter, and e is an input terminal to which the output value of the second waveform synthesizing circuit 44 is input.

Detection signals S2, S3 input to the input terminals a, b of the phase error detection circuit are subjected at the analog multipliers 61, 62 to a four-quadrant multiplication process with the output signal S1 of the second waveform synthesizing circuit 44 input to the input terminal e, whereby S1×S2, S1×S3 are obtained. Since the frequency of the output signal S1 of the second waveform synthesizing circuit 44 input to the input terminal e is set to be different by Δf from the frequency f0 of the detection signal S2, S3 at the input terminal a, b, an output signal from each multiplier 61, 62 includes a signal component having the frequency Δf. By sending the output signal of the multiplier 61, 62 through the low pass filter 63, 64 provided with an appropriate characteristic, only a signal of the frequency Δf is extracted.

In consequence of this, an output signal of the low pass filter 63, 64 shows a phase difference equal to that of the signal input to each input terminal a, b while having a frequency converted to the low frequency Δf fit to detect the phase difference. The signal of the frequency Δf is input to each waveform shaping circuit 65, 66 and converted to a rectangular wave signal.

The counter 69 counts reference clocks generated in the oscillation circuit 41 and outputs a counted value to the memory registers 67, 68. An output signal of each waveform shaping circuit 65, 66 is input to a gate of each memory register 67, 68, so that the memory contents in each memory register 67, 68 are updated synchronously with a rise edge of the output signal of the waveform shaping circuit 65, 66. The CPU 47 calculates values before and after each memory register 67, 68 is updated, thereby obtaining a cycle of the signal of the frequency Δf and operating a difference of values read out from the memory registers 67 and 68. A time difference resulting from the phase difference and measured with the cycle of the reference clock is thus detected. The phase difference is obtained from the cycle and the time difference detected as above.

Figure 5:
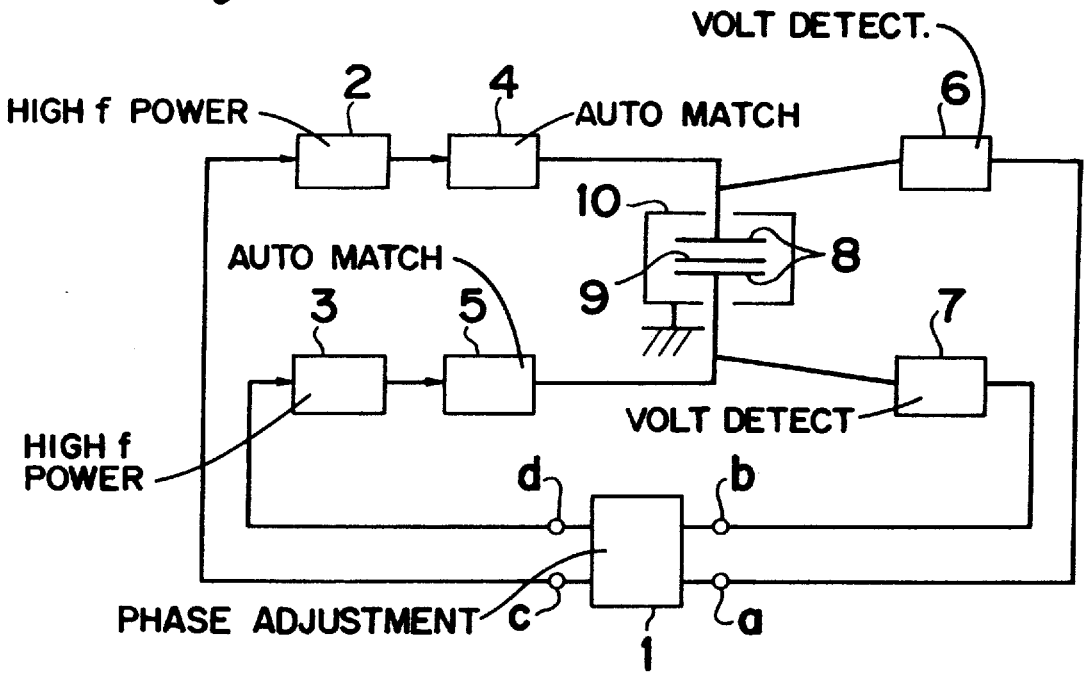
FIG. 5 is a block diagram of a plasma processing apparatus.
Figure 6:
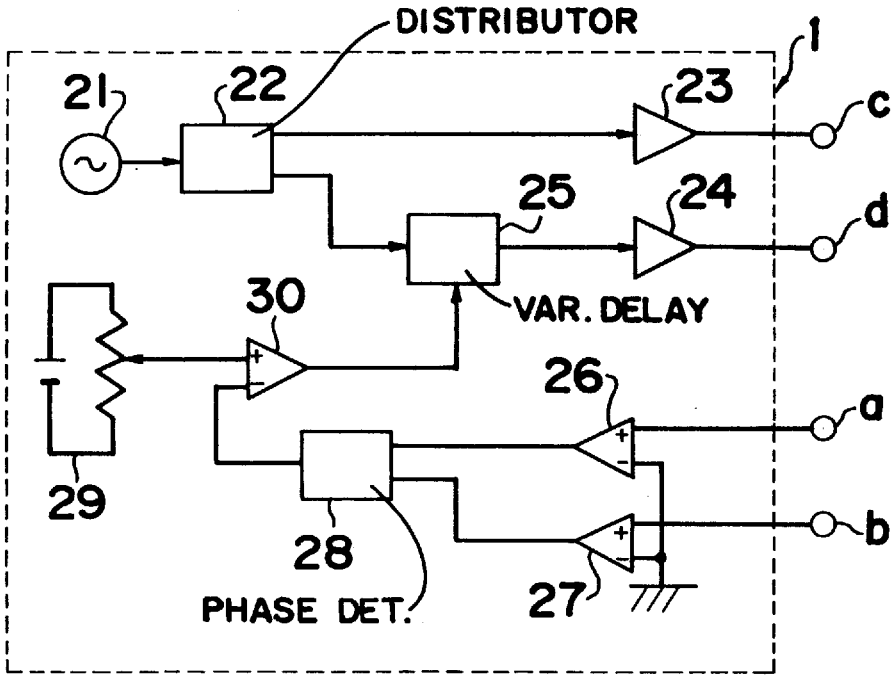
Fig. 6 PRIOR ART
FIG. 6 is a block diagram of a conventional phase adjustment circuit.
Figure 8:
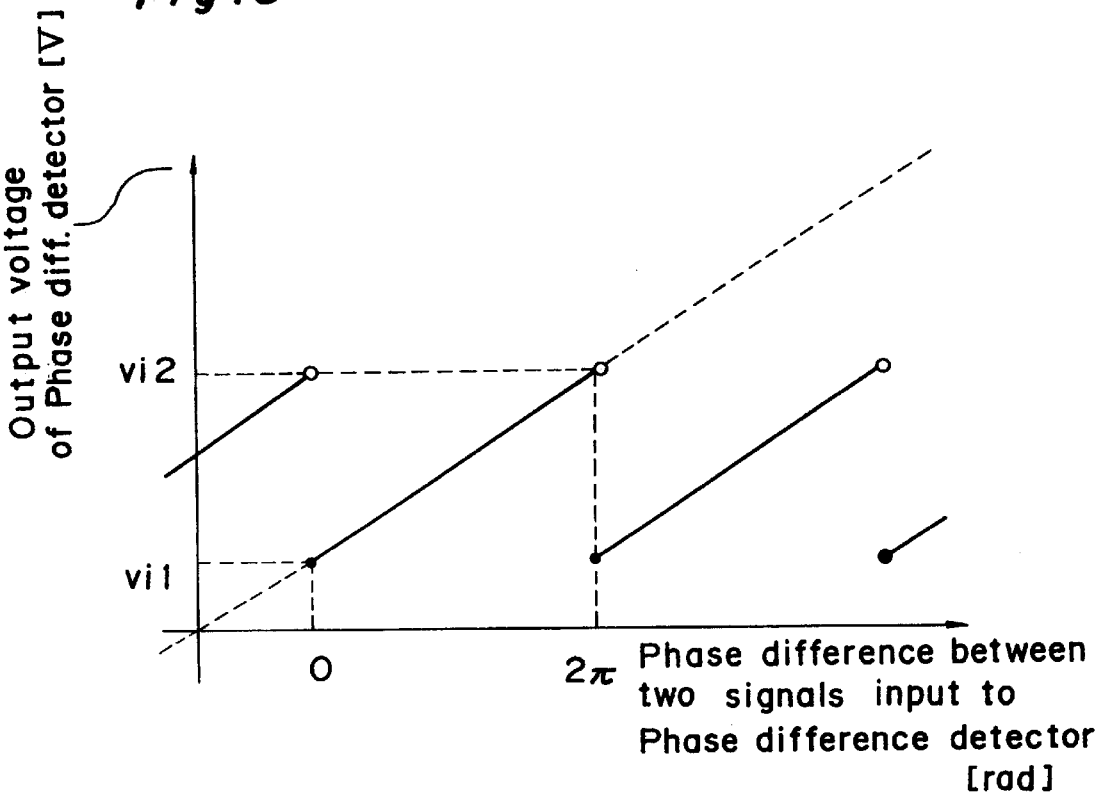
FIG. 8 is a graph showing a relation of a voltage and a phase difference in a conventional phase difference detector.

The operation of the apparatus of FIG. 5 using the waveform synthesizing circuit of FIG. 6 and the phase difference detection circuit of FIG. 8 will be depicted.

In the apparatus shown in FIGS. 5–8, the detection signals S2 and S3 are input to the phase difference detection circuit 45 together with the output signal S1 of the second waveform synthesizing circuit 44 of the frequency f0+Δf or f0−Δf set slightly different from the frequency f0 by the input means 49. The phase difference detection circuit 45 calculates a signal corresponding to a phase difference of the detection signals S2 and S3. The phase difference detection signal obtained in the circuit 45 is compared by the CPU 47 with the phase difference setting signal set by the input means 49 and, a difference between the signals becomes a phase shift signal. A value calculated for the phase shift signal to be zero is stored in the phase shift setting register 55 of the third waveform synthesizing circuit 43. In the meantime, the frequency setting signal set by the input means 49 is stored in the frequency setting register 54 of each first, third waveform synthesizing circuit 42, 43.

Consequently, the sine wave signal of the set frequency f0 is output from the first waveform synthesizing circuit 42, while the sine wave signal having the set frequency f0 and a phase determined so that the voltage impressed on the electrode shows the set phase difference is output from the third waveform synthesizing circuit 43.

According to the present invention, both the phase difference of output signals is set, and the phase difference of input signals is detected, directly in digital values. Therefore, in comparison with the prior art handling the phase difference in analog values, the discontinuity generated when the phase difference detection circuit outputs repeatedly with the cycle of 2 π is eliminated. At the same time, the phase is not forcibly returned to one cycle earlier in the opposite direction to the natural changing direction even if the phase changes beyond the control range. The plasma is accordingly maintained stably. The present invention can not only control the phase difference of output signals continuously stably at all times, but can also deal with a wide range of frequencies.

The detection signal f0 input to the input terminal of the phase difference detection circuit is multiplied with the signal of the frequency f0+Δf or f0−Δf slightly different by Δf from f0 and passed through the low pass filter, whereby higher harmonics input to the phase adjustment circuit are removed and only the signal of the low frequency Δf is obtained. The detection accuracy for the phase difference is remarkably improved and influences due to high frequency waves are also eliminated.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A plasma processing apparatus wherein outputs of two high frequency power generators for processing of semiconductor wafers are respectively supplied to two plate electrodes in a plasma generation chamber thereby to generate plasma, outputs of said two high frequency power generators being shifted a predetermined value in phase by a phase adjustment circuit, said plasma processing apparatus comprises:

a frequency setting circuit for outputting pulse signals every predetermined interval;

a phase difference setting circuit;

first and second processing voltage detection circuits for detecting respectively terminal voltages at the plate electrodes in said plasma generation chamber;

a first waveform synthesizing circuit having an input from said frequency setting circuit thereby synthesizing/forming a high frequency signal of a predetermined waveform with a frequency f0 corresponding to the input;

a second waveform synthesizing circuit having an input from said frequency setting circuit thereby synthesizing/forming a high frequency signal of the same waveform as that generated in said first waveform synthesizing circuit and a frequency different by Δf (Δf<<f0) from the frequency of said first waveform synthesizing circuit;

a phase difference detection circuit having inputs of an output from said second waveform synthesizing circuit and detection signals of said first and second processing voltage detection circuits, said phase difference detection circuit outputting a voltage of the frequency Δf and corresponding to a phase difference of the detection signals of said processing voltage detection circuits;

a third waveform synthesizing circuit for outputting a high frequency signal with a phase determined by a difference signal between a set value of said phase difference setting circuit and an output of said phase difference detection circuit and the same frequency and the same waveform as those of said first waveform synthesizing circuit, and a central processing unit (CPU) for supervising said frequency setting circuit, phase difference setting circuit, first and second processing voltage detection circuits, first through third waveform synthesizing circuits and phase difference detection circuit, whereby said phase adjustment circuit determines one output power of said two high frequency power generators in accordance with the output of said first waveform synthesizing circuit and the other output power in accordance with the output of said third waveform synthesizing circuit.

2. A plasma processing apparatus according to claim 1, wherein said first waveform synthesizing circuit comprises a direct digital synthesizing (DDS) circuit which includes an adder having inputs of pulses from said frequency setting circuit thereby sequentially adding the inputs, a waveform memory circuit for storing peak values corresponding to output values of the first adder and a D/A converter for converting an output value read out from said waveform memory circuit to an analog value.

3. A plasma processing apparatus according to claim 2, wherein said third waveform synthesizing circuit comprises a direct digital synthesizing (DDS) circuit which includes a first adder having inputs of pulses output from said frequency setting circuit thereby sequentially adding the inputs, a second adder for adding an output value of the first adder to the phase error signal, a waveform memory circuit for storing peak values corresponding to output values of the second adder, and a D/A converter for converting an output value read out from said waveform memory circuit to an analog value.

4. A plasma processing apparatus according to claim 3, wherein said phase difference detection circuit is provided with a first and a second analog multipliers having inputs of an output signal S1 from said second waveform synthesizing circuit and output signals S2 and S3 from said first and second processing voltage detection circuits, thereby obtaining S1×S2 and S1×S3, a first and a second low pass filters passing only components of the frequency Δf among outputs of the first and second analog multipliers, two waveform shaping circuits for converting outputs of the first and second low pass filters to rectangular waves respectively, and an operation circuit for obtaining a voltage corresponding to a rise time difference or fall time difference of outputs of the waveform shaping circuits.

5. A plasma processing apparatus according to claim 2, wherein said phase difference detection circuit is provided with a first and a second analog multipliers having inputs of an output signal S1 from said second waveform synthesizing circuit and output signals S2 and S3 from said first and second processing voltage detection circuits, thereby obtaining S1×S2 and S1×S3, a first and a second low pass filters passing only components of the frequency Δf among outputs of the first and second analog multipliers, two waveform shaping circuits for converting outputs of the first and second low pass filters to rectangular waves respectively, and an operation circuit for obtaining a voltage corresponding to a rise time difference or fall time difference of outputs of the waveform shaping circuits.

6. A plasma processing apparatus according to claim 1, wherein said third waveform synthesizing circuit comprises a direct digital synthesizing (DDS) circuit which includes a first adder having inputs of pulses output from said frequency setting circuit thereby sequentially adding the inputs, a second adder for adding an output value of the first adder to the phase error signal, a waveform memory circuit for storing peak values corresponding to output values of the second adder, and a D/A converter for converting an output value read out from said waveform memory circuit to an analog value.

7. A plasma processing apparatus according to claim 6, wherein said phase difference detection circuit is provided with a first and a second analog multipliers having inputs of an output signal S1 from said second waveform synthesizing circuit and output signals S2 and S3 from said first and second processing voltage detection circuits, thereby obtaining S1×S2 and S2×S3, a first and a second low pass filters passing only components of the frequency Δf among outputs of the first and second analog multipliers, two waveform shaping circuits for converting outputs of the first and second low pass filters to rectangular waves respectively, and an operation circuit for obtaining a voltage corresponding to a rise time difference or fall time difference of outputs of the waveform shaping circuits.

8. A plasma processing apparatus according to claim 1, wherein said phase difference detection circuit is provided with a first and a second analog multipliers having inputs of an output signal S1 from said second waveform synthesizing circuit and output signals S2 and S3 from said first and second processing voltage detection circuits, thereby obtaining S1×S2 and S1×S3, a first and a second low pass filters passing only components of the frequency Δf among outputs of the first and second analog multipliers, two waveform shaping circuits for converting outputs of the first and second low pass filters to rectangular waves respectively, and an operation circuit for obtaining a voltage corresponding to a rise time difference or fall time difference of outputs of the waveform shaping circuits.

* * * * *

UNITED STATES PATENT AND TRADEMARK OFFICE

CERTIFICATE OF CORRECTION

PATENT NO. : 5,844,369
DATED : December 1, 1998
INVENTOR(S) : Y. Yoshizako, et al.

It is certified that error appears in the above-identified patent and that said Letters Patent is hereby corrected as shown below:

Column 4:
Line 30, "is a type" should read --of the type--

Column 5:
Line 30, "input outputs" should read --input, outputs--

Column 7:
Line 13, "F1/F2" should read --F2/F1--

Column 9:
Line 45, Claim 3: "claim 2" should read --claim 1--
Line 56, Claim 4: "claim 3" should read --claim 1--

Column 10:
Line 22, Claim 6: "claim 1" should read --claim 2--
Line 39, Claim 7: "52x53" should read --51x53--

Signed and Sealed this

Nineteenth Day of June, 2001

*Attest:*

Nicholas P. Godici

*Attesting Officer*

NICHOLAS P. GODICI
*Acting Director of the United States Patent and Trademark Office*